United States Patent [19]

Tomida

[11] Patent Number: 4,695,173

[45] Date of Patent: Sep. 22, 1987

[54] PRINTING APPARATUS WITH A THERMAL PRINT HEAD

[75] Inventor: Yasutaka Tomida, Nagoya, Japan

[73] Assignee: Brother Kogyo Kabushiki Kaisha, Aichi, Japan

[21] Appl. No.: 889,307

[22] Filed: Jul. 28, 1986

Related U.S. Application Data

[63] Continuation of Ser. No. 681,682, Dec. 14, 1984, abandoned.

[30] Foreign Application Priority Data

Dec. 20, 1983 [JP] Japan ..... 58-240610
Dec. 20, 1983 [JP] Japan ..... 58-240611

[51] Int. Cl.[4] ..... B41J 3/00; D21H 1/22

[52] U.S. Cl. ..... 400/120; 400/578; 400/719; 219/216; 346/76 PH; 427/411; 134/122 R

[58] Field of Search ..... 400/120, 618, 641, 636, 400/636.3, 616.3, 635, 611, 578; 219/216; 346/76 PH; 427/411; 134/122 R

[56] References Cited

U.S. PATENT DOCUMENTS

| | | | |
|---|---|---|---|
| 3,917,048 | 11/1975 | Riley | 400/120 X |
| 3,968,679 | 7/1976 | Ralbursky | 226/45 X |
| 4,140,907 | 2/1979 | Oba | 400/120 X |
| 4,165,029 | 8/1979 | Mitchell | 400/618 X |
| 4,173,420 | 11/1979 | Okabe | 400/120 |
| 4,314,757 | 2/1982 | Anderson et al. | 226/45 X |
| 4,322,044 | 3/1982 | Bilek | 400/120 X |
| 4,434,637 | 3/1984 | Bailey | 226/45 |
| 4,470,055 | 9/1984 | Todoh | 400/120 X |

FOREIGN PATENT DOCUMENTS

| | | | |
|---|---|---|---|
| 134446 | 11/1978 | Japan | 400/120 |
| 10474 | 2/1981 | Japan | 400/120 |
| 25459 | 3/1981 | Japan | 400/120 |
| 49290 | 5/1981 | Japan | 400/618 |
| 32990 | 2/1982 | Japan | 400/120 |
| 144780 | 9/1982 | Japan | 400/120 |
| 173163 | 10/1982 | Japan | 427/411 |
| 7376 | 1/1983 | Japan | 400/120 |
| 8669 | 1/1983 | Japan | 400/120 |
| 50543 | 3/1983 | Japan | 427/411 |
| 183281 | 10/1983 | Japan | 400/120 |
| 1274 | 1/1984 | Japan | 400/120 |
| 76281 | 5/1984 | Japan | 400/120 |
| 72913 | 8/1953 | Switzerland | 427/411 |

OTHER PUBLICATIONS

Xerox Disc. Jour., "Wrinkle Control Rolls", Wong et al., vol. 8, No. 4, Jul./Aug. 1983, pp. 289-290.

IBM Tech. Disc. Bulletin, "Wrinkle Eliminator for Continuous Roll Paper Feed", vol. 26, No. 4, Sep. 1983, pp. 1841-1842.

IBM Tech. Dscl. Bulletin, "Web-Tension Sensing Devices", Buchholz et al., vol. 25, No. 4, Sep. 1982, pp. 2066-2067.

IBM Tech. Dscl. Bulletin, "Tape Tension Detection", Dang et al., vol. 26, No. 6, Nov. 1983, pp. 2990-2991.

*Primary Examiner*—Charles A. Pearson
*Assistant Examiner*—James R. McDaniel
*Attorney, Agent, or Firm*—Parkhurst & Oliff

[57] ABSTRACT

A printing apparatus for printing on a sheet of paper via a thermal ribbon has a paper feeding device for feeding the sheet of paper; a thermal print head including heat generating elements which are held in pressed contact with the surface of the sheet of paper via the thermal ribbon, the heat generating elements being selectively energized to apply heat to an ink layer of the thermal ribbon to fuse the ink for adherence of the fused ink to the surface of the paper; and a smoothness improving device, disposed upstream of the thermal print head in the direction of feed of the sheet of paper by the paper feeding device, for improving the smoothness of the surface of the paper.

5 Claims, 11 Drawing Figures

PRINTING APPARATUS WITH A THERMAL PRINT HEAD

This is a continuation of application Ser. No. 681,682 filed Dec. 14, 1984 which in turn is now abandoned.

BACKGROUND OF THE INVENTION

The present invention relates to a thermally printing apparatus for printing on a sheet of paper via a thermal ribbon having a thermally transferable ink layer, which has a thermal print head including heat generating elements which are held in pressed contact with the surface of the sheet of paper via the thermal ribbon and which are selectively energized to apply heat to the ink layer of the thermal ribbon to fuse the ink for adherence of the fused ink to the surface of the paper to print characters, symbols, graphical representations, etc.

In a commonly known thermally printing apparatus constructed as shown in FIG. 11, a printing operation is achieved by pressing a thermal print head 108, via a thermal ribbon 112, against a relatively uneven surface of a sheet of paper 114 set on a platen 113. When heat is generated by heat generating elements 108*a* at a front end portion of the thermal print head 108, an ink 112*b* on the thermal ribbon 112 is fused and adheres to the surface of the paper 114. After the thermal ribbon 112 is pulled via a separating roller 116 and separated from the paper 114, layers of the ink are transferred to the paper 114, as indicated at a, b, c, d and e in FIG. 17. In such a thermal printer, the use of a sheet of paper having an unsmooth or uneven printing surface will lead to application of a thin ink as seen at b or partial application of the ink as shown at c due to the roughness or unevenness of the surface, resulting in reduced printing density, unevenly or partially printed characters and figures, and other defects. Consequently, the print quality on the paper 114 will be reduced as a whole.

SUMMARY OF THE INVENTION

It is therefore an object of the present invention to provide a printing apparatus having a thermal print head, which is capable of performing a high-quality printing on an unsmooth or uneven printing surface of a sheet of paper.

It is another object of the invention to provide a thermal printer which is capable of improving print quality by improving the smoothness of a sheet of paper prior to printing.

It is a further object of the invention to provide a thermal printer which achieves the above-mentioned purpose in a simple arrangement.

According to the present invention, there is provided a printing apparatus for printing on a sheet of paper via a thermal ribbon having a thermally transferable ink layer. The printing apparatus comprises a paper feeding device for feeding the sheet of paper, and a thermal print head including heat generating elements which are held in pressed contact with the surface of the sheet of paper via the thermal ribbon. The heat generating elements are selectively energized to apply heat to the ink layer of the thermal ribbon to fuse the ink for adherence of the fused ink to the surface of the paper. The printing apparatus further comprises smoothness improving means, disposed upstream of the thermal print head in the direction of feed of the sheet of paper by the paper feeding device, for improving the smoothness of the surface of the paper.

According to one embodiment of the invention, the smoothness improving means comprises means for applying a liquid to the surface of the paper.

In another embodiment of the invention, the smoothness improving means comprises a coating device for coating the paper with a coating agent for improving the smoothness of its surface.

In the above embodiment, the smoothness improving device may further comprise a drying device for drying the coating agent applied to the paper by the coating device.

In another advantageous embodiment of the invention, the smoothness improving device comprises a humidifying device for humidifying the sheet of paper, and a pressing device for applying a pinching pressure to opposite surfaces of the humidified sheet of paper. In this form of the printing apparatus, the smoothness improving device may further comprise a heating device for applying heat to the humidified sheet of paper.

In the above form of the invention, the pressing device may comprise at least one pair of rollers rotatable in rolling pressed contact with the surface of the humidifed sheet of paper, and the heating device may comprise a heating element which is incorporated in at least one of the at least one pair of rollers and which applies heat to the paper via the at least one of the rollers.

BRIEF DESCRIPTION OF THE DRAWINGS

The above and other objects, features and advantages of the present invention will become more apparent from reading the following description of the preferred embodiment taken in connection with the accompanying drawings in which.

DETAILED DESCRIPTION OF THE PREFERRED EMBODIMENT

Referring now to the accompanying drawings, the invention will be more fully described in its preferred embodiments. It is to be understood, however, that the invention is not confined to the precise disclosure and that changes and modifications may be made herein which do not affect the spirit of the invention nor exceed the scope thereof as expressed in the appended claims.

Figure 1:
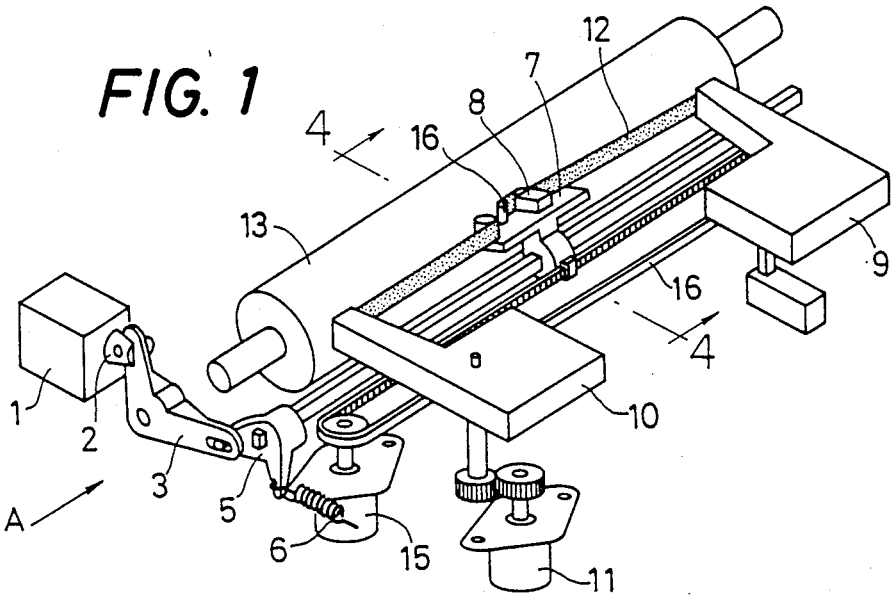
FIG. 1 is a perspective view of one embodiment of a printing apparatus of the invention, showing its mechanism.
Figure 2:
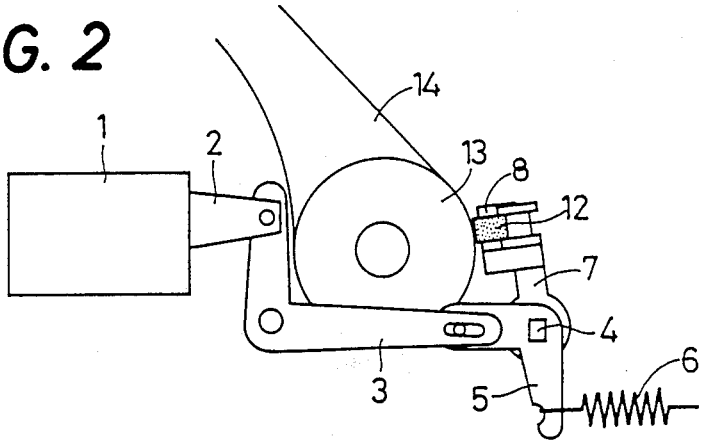
FIG. 2 is an enlarged view taken in the direction of arrow A, showing a thermal print head while it is held in contact with a platen.
Figure 3:
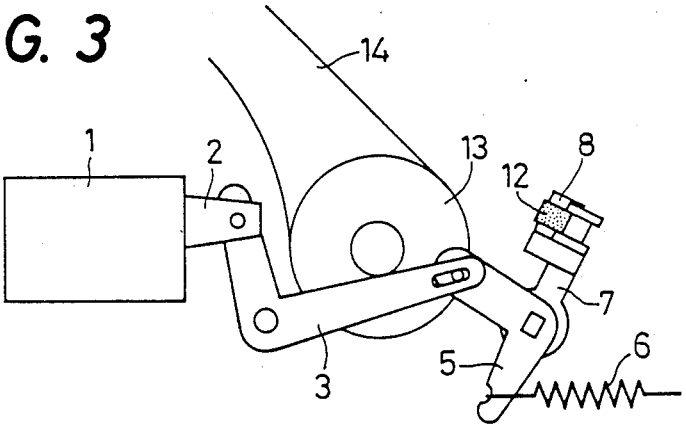
FIG. 3 is a view corresponding to FIG. 2 showing the thermal print head while it is located away from the platen.

There is shown in FIGS. 1–3 a printing apparatus in one preferred form of the invention, which comprises a solenoid 1 having a plunger 2 which is operatively connected to a guide bar 4 through a first and a second pivotal lever 3, 5. One arm of the first lever 3 is connected to the external end of the plunger 2, and the other arm of the first lever 3 engages one arm of the second lever 5. This second lever 5 is fixed to the guide bar 4 such that the pivotal movement of the second lever 5 about the axis of the guide bar 4 will cause the guide bar 4 to be rotated. The second lever 5 is biased by a spring 6 in a counterclockwise direction as viewed in FIG. 2. The guide bar 4 extends through a carriage 7 so that the carriage 7 is supported slidably on the guide bar 4. The carriage 7 carries a thermal print head 8. While the solenoid is off (i.e., while the plunger 2 is at its extended position), the print head 8 is held under action of the spring 6 in pressed contact, via a thermal ribbon 12, with a sheet of paper 14 placed on a platen 13 extending along the guide bar 4, as illustrated in FIG. 2. This thermal ribbon 12 which has a thermally transferable ink layer (as indicated at 31*b* in FIG. 6), is fed at appropriate timings from a removable feed cassette 9 toward a removable take-up cassette 10 through rotation of a ribbon drive motor 11 operatively connected to the take-up cassette 10. The carriage 7 is driven by a carriage drive motor 15 via a timing belt 16.

Figure 4:
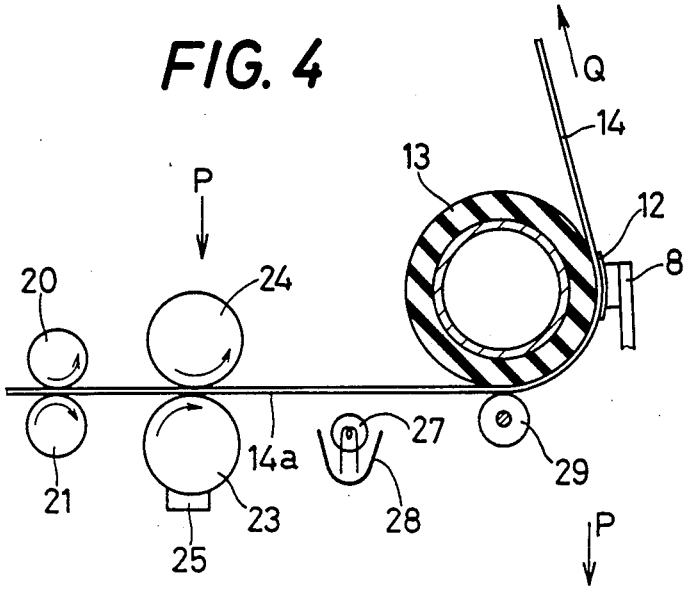
FIG. 4 is a cross sectional view of the apparatus taken generally along the line 4—4 of FIG. 1.

In the thermally printing apparatus constructed as described above, when a sheet of paper having an unsmooth printing surface is supplied, the paper is fed through a clearance between the platen 13 and the thermal print head 8 after its smoothness is improved. Such a smoothness improving device is shown in FIG. 4. A pair of paper feed rollers 20, 21 pinch a sheet of paper 14 supplied, and feed the paper 14 to the platen 13. Numerals 23 and 24 indicate a pair of coating rollers. The coating roller 23 located on the side of the printing surface 14*a* of the paper 14 is disposed in contact with a coating member 25 which is impregnated with a suspension of a loading material or filler such as talc, gypsum, calcium carbonate or titanium oxide, or with a suspension of a mixture of such fillers, so that a coating agent 26 consisting of the filler or fillers is applied to the surface of the coating roller 23. Another coating roller 24 is forced toward the above described coating roller 23 with a pinching pressure P. Consequently, the coating agent 26 is applied to the printing surface 14*a* of the paper 14 by the coating roller 23.

A heating element 27 for drying the coating agent 26 applied to the printing surface 14*a* of the paper 14 is equipped with a heat reflector 28. A paper retaining roller 29 pinches the paper 14 in cooperation with the platen 13, and feeds the paper 14 through a clearance between the platen 13 and the thermal print head 8 in a direction indicated by arrow Q. The thermal ribbon 12 is pressed against the paper 14 and heated by the thermal head 8 when a printing operation is effected.

Figure 5:
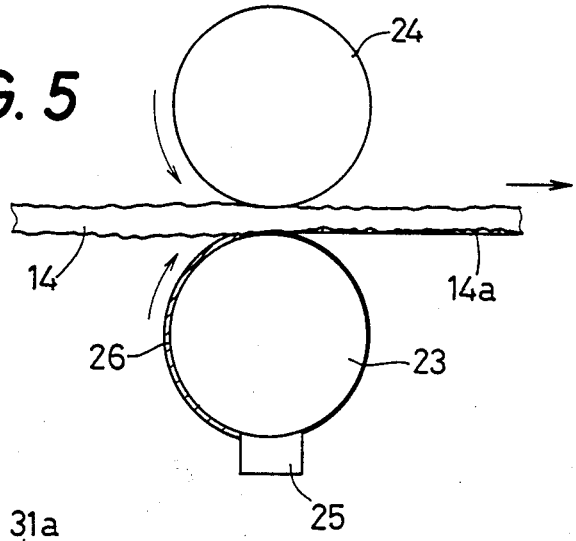
FIG. 5 is an enlarged cross sectional view of the pressing rollers of FIG. 4, showing a smoothing operation of a sheet of paper.

In the thermally printing apparatus constructed as described hitherto, a printing process proceeds as explained below. The paper 14 is first fed between the pair of paper feed rollers 20, 21. As shown in FIG. 5, the coating roller 23 rotating in the clockwise direction is supplied with a layer of the coating agent 26 (filling material) by the coating member 25 impregnated with a suspension of the coating agent 26, and applies the coating agent 26 to minute concavities or indentations in the printing surface 14a of the paper 14. At this time, the coating roller 24 rotates in the counterclockwise direction and presses the paper 14 against the coating roller 23 with the pinching pressure P, whereby the appropriate amount of the coating agent 26 can be applied to the paper 14, and at the same time, the printing surface 14a can be smoothed with the minute concavities filled with the coating agent 26. The coating roller 24 also provides an appropriate backward tension to a portion of the paper 14 located between the pair of coating rollers 23, 24, and a set of the platen 13 and paper retaining roller 29.

Figure 6:
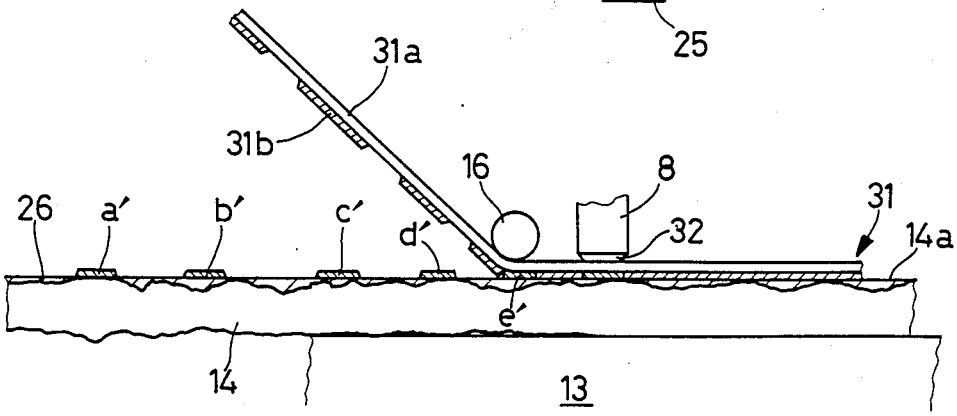
FIG. 6 is a fragmentary, cross sectional view of the printing apparatus of FIGS. 1–5, showing the printing condition.

Furthermore, the heating element 27 completely dries the coating agent 26 applied to the printing surface 14a of the paper 14, thereby improving the smoothness of the printing surface 14*a* of the paper 14. The paper 14 is then fed through a clearance between the platen 13 and the thermal ribbon 12 by the platen 13 and the paper retaining roller 29. When printing is executed, a portion of the thermal ribbon 12 located between the paper 14 and heat generating elements 32 at the front end portion of the thermal print head 8 is brought into pressed contact with the paper 14 by the thermal print head 8, as shown in FIG. 6, and heat is generated by the heat generating elements 32. The heat is transmitted to an ink 31*b* through a film 31*a* of the thermal ribbon 12, whereby the ink 31*b* is fused and adheres to the paper 14. After the thermal ribbon 12 is pulled via a separating roller 16 and separated from the paper 14, characters as indicated at a', b', c', d' and e' having predetermined widths and thicknesses of the ink are transferred to the smoothed printing surface 14*a* of the paper 14.

In the above-mentioned embodiment, a simple substance of starch, resin, wax or a similar matter, or a mixture thereof, may be used as a coating agent instead of the previously indicated fillers. Also, any means that completely dries the coating agent, such as a heat blower, may be utilized as the heating element 27.

Figure 7:
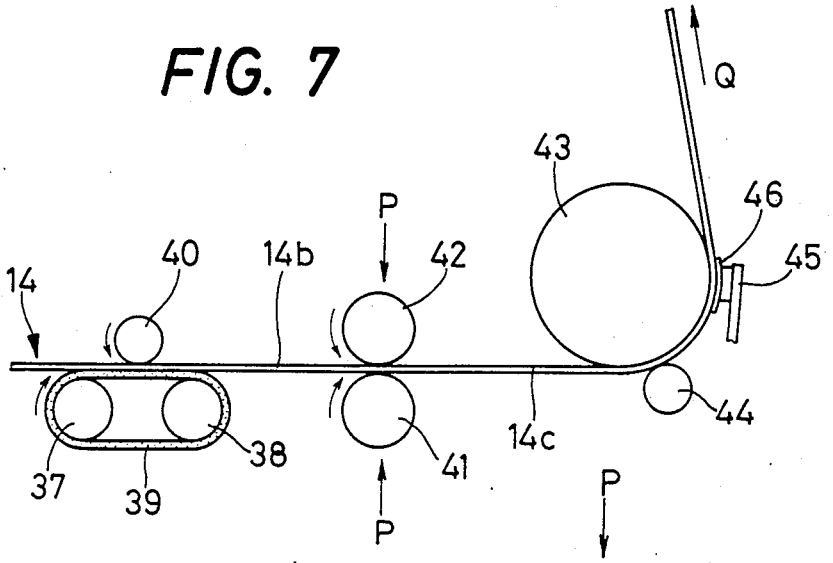
FIGS. 7–9 are fragmentary, cross sectional views of another embodiment of the invention, corresponding to FIGS. 4–6, respectively.
Figure 8:
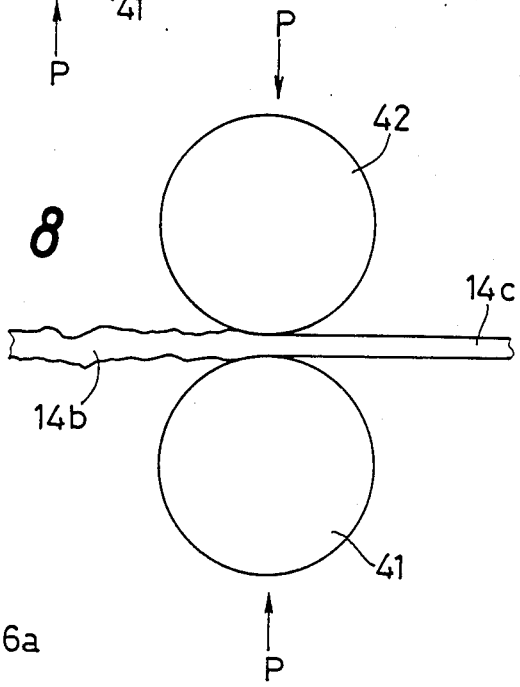
Figure 9:
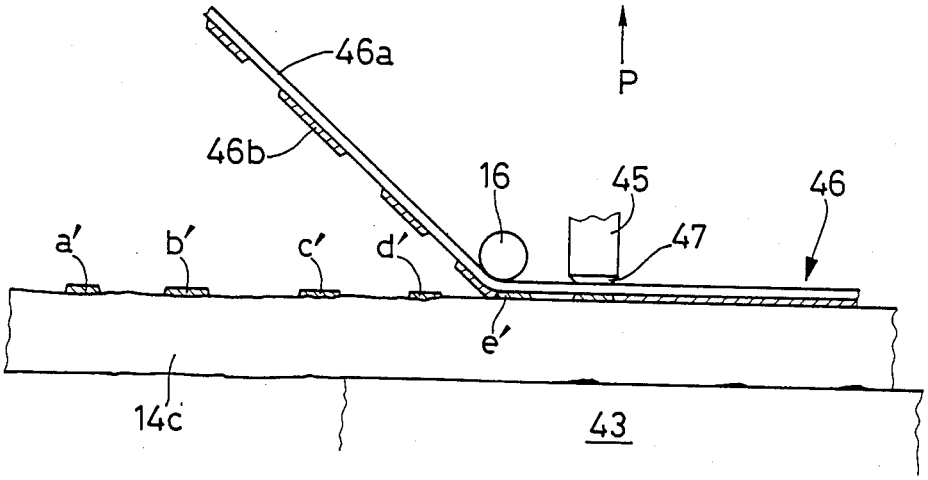

Referring now to FIGS. 7–9, another embodiment of the present invention will be described.

As shown in FIG. 7, the paper 14 inserted is humidified according to the invention by humidifying means which comprises a humidifying felt belt 39 rotated by belt rollers 37, 38, and a paper feed roller 40. The humidified and thus swollen paper 14*b* is then fed through a clearance between a pair of pressing rollers 41 and 42, by the humidifying felt belt 39 and the feed roller 40. Since a pinching pressure P is applied to the pressing rollers 41, 42, the surfaces of the paper 14*b* are smoothed as shown in FIG. 8. The smoothed paper 14*c* is then fed through a clearance between a platen 43 and a paper retaining roller 44. The platen 43 and the paper retaining roller 44 cooperatively holding the smoothed paper 14*c* provide a proper tension to the paper 14 located between the pressing rollers 41, 42, and the platen 43 and paper retaining roller 44, and pass the paper 14 through a clearance between the platen 43 and a thermal print head 45, thereby feeding the paper 14 in the direction indicated by arrow Q. A thermal ribbon 46 is located between the paper 14 and the thermal print head 45. When printing is performed, the thermal ribbon 46 is pressed against the paper 14 and also heated by the thermal print head 45.

In the thermal printer constructed as described above, a printing process proceeds as explained hereunder. The paper 14 supplied is first humidified and softened by the humidifying felt belt 39 and the feed roller 40. Then, the smoothness of the surfaces of the softened paper 14*b* is improved by the pressing rollers 41, 42. Particularly, a sheet of bond paper which is often used as a letter paper is greatly improved in smoothness. For example, the smoothness of a sheet of paper with 25% cotton fiber is improved from 9 sec. to more than 80 sec. in Bekk smoothness (as compared to 60–70 sec. when only the pressing operation is effected).

The smoothed paper 14*c* is then fed through a clearance between the platen 43 and the thermal ribbon 46 by the platen 43 and the paper retaining roller 44. When a printing operation is performed, a portion of the thermal ribbon 46 located between the paper 14 and heat generating elements 47 at the front end portion of the thermal print head 45 is brought into pressed contact with the paper 14 by the thermal print head 45, and heat is generated by the heat generating elements 47. The heat is transmitted to an ink 46*b* through a film 46*a* of the thermal ribbon 46, whereby the ink 46*b* is fused and adheres to the paper 14*c*. After the thermal ribbon 46 is pulled via a separating roller 16 and separated from the paper 14*c*, characters as indicated at a', b', c', d' and e' in FIG. 9 having predetermined widths and thicknesses of the ink are transferred to the smoothed paper 14*c*.

Figure 10:
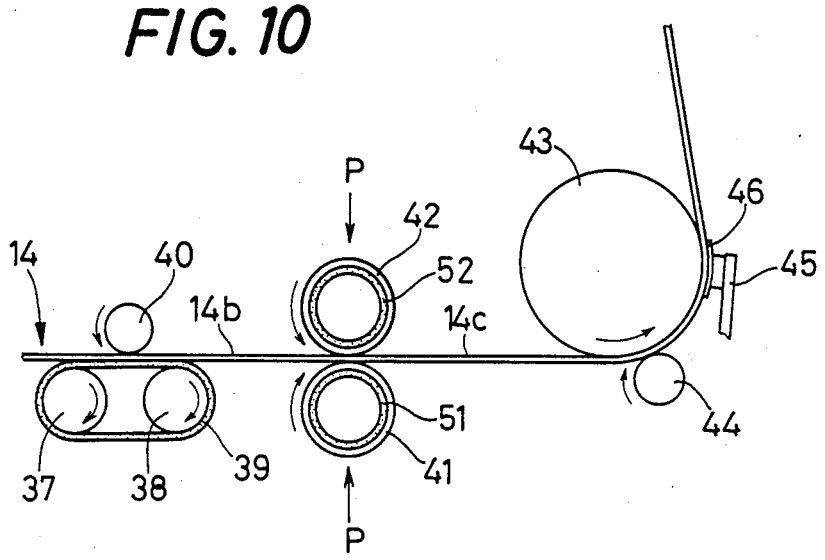
FIG. 10 is a fragmentary, cross sectional view of a further embodiment of the invention, corresponding to FIG. 4.
Figure 11:
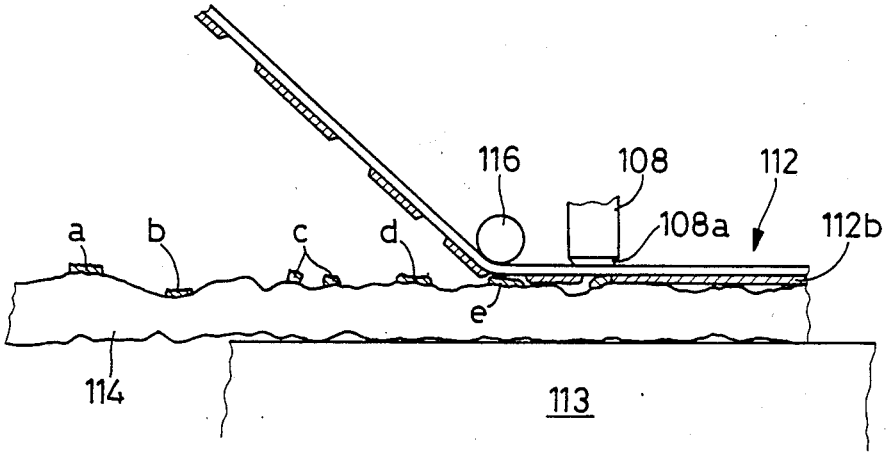
FIG. 11 PRIOR ART
FIG. 11 is a fragmentary, cross sectional view of an example of a conventional thermally printing apparatus, showing its printing condition.

As shown in FIG. 10, it is appreciated to provide heating elements 51, 52 inside the pressing rollers 41, 42 of the preferred embodiment shown in FIGS. 7–9, to effect evaporation of water from the paper 14, whereby an adverse effect of the water in the paper 14 (reduction in thermal transfer efficiency of the ink 46b because the heat from the heat generating elements 47 is absorbed by the water) is eliminated. Also, the smoothness of the paper 14 can be further improved.

Further, it is possible to apply steam to the paper 14 by use of a supersonic humidifier or similar device instead of using the aforementioned humidifying felt belt 39. This modified arrangement permits the paper 14 to be more softened and results in improved smoothness of the surface of the paper 14.

What is claimed is:

1. A printing apparatus using a thermal ribbon having a thermally transferable ink layer to print on a sheet of paper, comprising:

a paper feeding device for feeding the sheet of paper;

a thermal pring head including heat generating elements which are held in pressed contact with the surface of said sheet of paper via said thermal ribbon, said heat generating elements being selectively energized to apply heat to said ink layer of the thermal ribbon to fuse the ink for adherence of the fused ink to the surface of the sheet of paper; and smoothness improving means, disposed upstream of said thermal print head in the direction of feed of the sheet of paper by said paper feeding device, for improving the surface smoothness of the surface of the sheet of paper, said smoothness improving means comprising a humidifying device for humidifying and swelling said sheet of paper, a pressing device located downstream of the humidifying device for applying a pinching pressure to opposite surfaces of said swollen sheet of paper, and means for applying heat to the swollen sheet of paper downstream of the humidifying device.

2. The printing apparatus of claim 1, wherein said pressing device comprises at least one pair of rollers rotatable in rolling pressed contact with the surface of the swollen sheet of paper, and said means for applying heat comprises a heating element incorporated in at least one of said at least one pair of rollers, said heating element applying heat to the sheet of paper via said at least one of the rollers.

3. A printing apparatus for printing on a sheet of paper via a thermal ribbon having a thermally transferable ink layer, comprising:

a paper feeding device for feeding the sheet of paper;

a thermal print head including heat generating elements which are held in pressed contact with the surface of said sheet of paper via said thermal ribbon, said heat generating elements being selectively energized to apply heat to said ink layer of the thermal ribbon to fuse the ink for adherence of the fused ink to the surface of the sheet of paper; and smoothness improving means, disposed upstream of said thermal print head in the direction of feed of the sheet of paper by said paper feeding device, for improving the surface smoothness of the surface of the sheet of paper, said smoothness improving means comprising means for humidifying and swelling said sheet of paper, a pressing device located downstream of said swelling means and having a plurality of pressing members for applying a pressure to opposite surfaces of the swollen sheet of paper, and a heating element incorporated in at least one of said pressing members for applying heat to said swollen sheet of paper via said at least one of the pressing members while the swollen sheet of paper is pressed by the pressing members.

4. The printing apparatus of claim 3, wherein said humidifying and swelling means comprises means for applying steam to the surface of the sheet of paper.

5. The printing apparatus of claim 3, wherein said pressing members comprise at least one pair of rollers rotatable in rolling pressed contact with the surface of the swollen sheet of paper.

* * * * *